United States Patent [19]

Thomaswick

[11] 3,939,978

[45] Feb. 24, 1976

[54] FLAT GLASS SHIPPING CONTAINER

[75] Inventor: Ronald J. Thomaswick, Kittanning, Pa.

[73] Assignee: PPG Industries, Inc., Pittsburgh, Pa.

[22] Filed: July 23, 1974

[21] Appl. No.: 490,837

[52] U.S. Cl. ..... 206/454; 206/453; 206/497; 206/523; 229/DIG. 1

[51] Int. Cl.[2] ..... B65D 65/02; B65D 65/44; B65D 81/04; B65D 85/48

[58] Field of Search ..... 206/453–456, 206/497, 521, 523; 217/27, 35; 229/14 C, 40, DIG. 12, DIG. 1

[56] References Cited

UNITED STATES PATENTS

| | | | |
|---|---|---|---|
| 1,890,467 | 12/1932 | McCarroll | 206/521 UX |
| 2,196,293 | 4/1940 | Dubas | 206/454 X |
| 2,376,530 | 5/1945 | Dittmann | 229/14 C |
| 2,742,145 | 4/1956 | Blackburn et al. | 229/14 C |
| 3,339,722 | 9/1967 | Antwerpen | 206/453 |
| 3,356,209 | 12/1967 | Pezely, Jr. | 229/14 C X |
| 3,669,255 | 6/1972 | Raymus | 206/497 X |
| 3,695,421 | 10/1972 | Wood | 206/523 |
| 3,792,771 | 9/1974 | Johnson | 206/455 |
| 3,804,237 | 4/1974 | Christensen et al. | 206/453 X |

*Primary Examiner*—William Price
*Assistant Examiner*—Steven E. Lipman
*Attorney, Agent, or Firm*—Donald Carl Lepiane

[57] ABSTRACT

Flat glass sheets having a rectangular shape are stacked on a piece of corrigated fiberboard cut and scored to form a closed shipping container when folded. A corner pad that (1) absorbs shock; (2) is compressible; and (3) is resilient is provided at each corner of the stack. The height of the corner pads is greater than inside depth of the container when folded so that the corner pads are compressed between the top and bottom surfaces of the container.

13 Claims, 7 Drawing Figures

FIG. 1
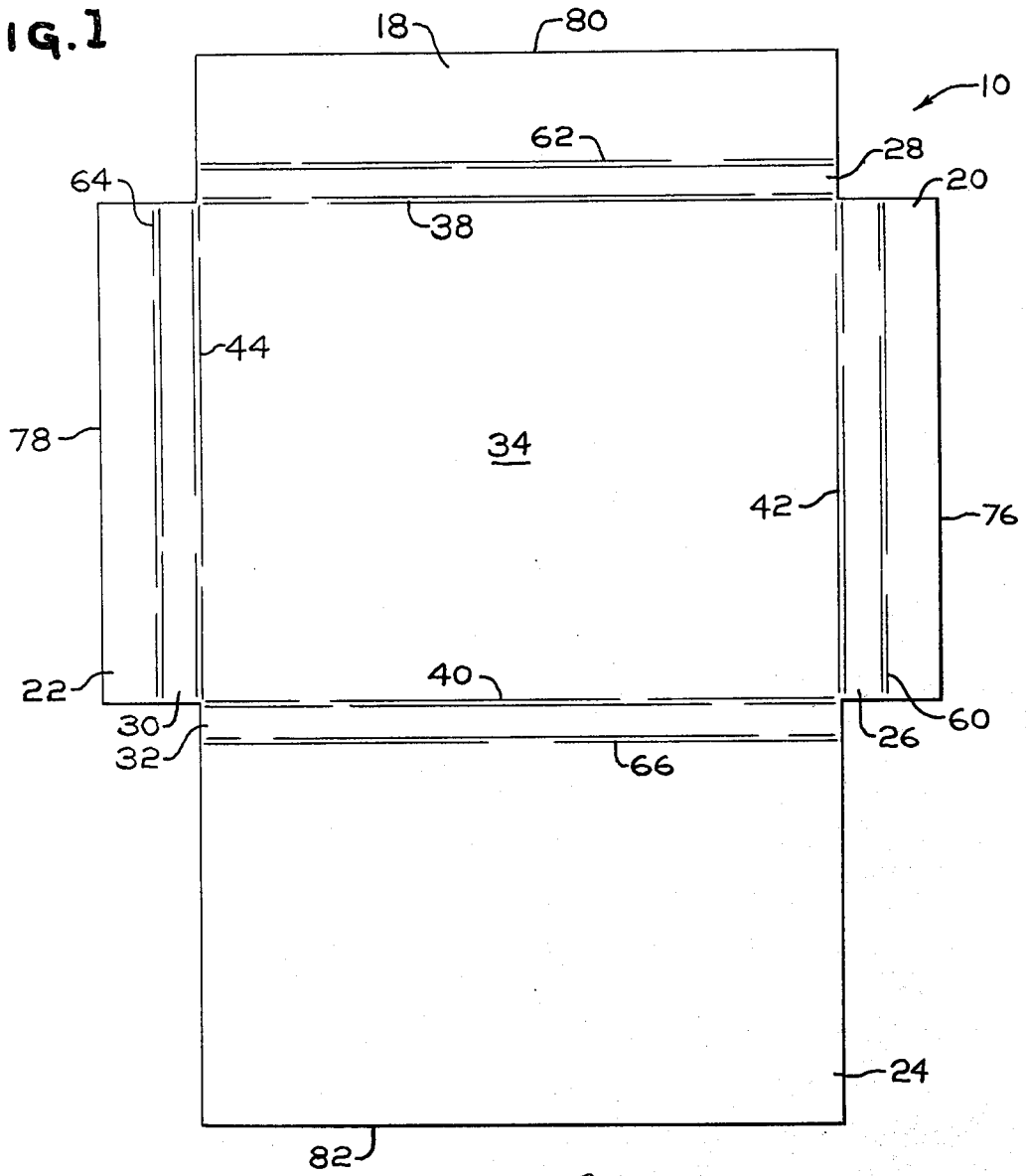
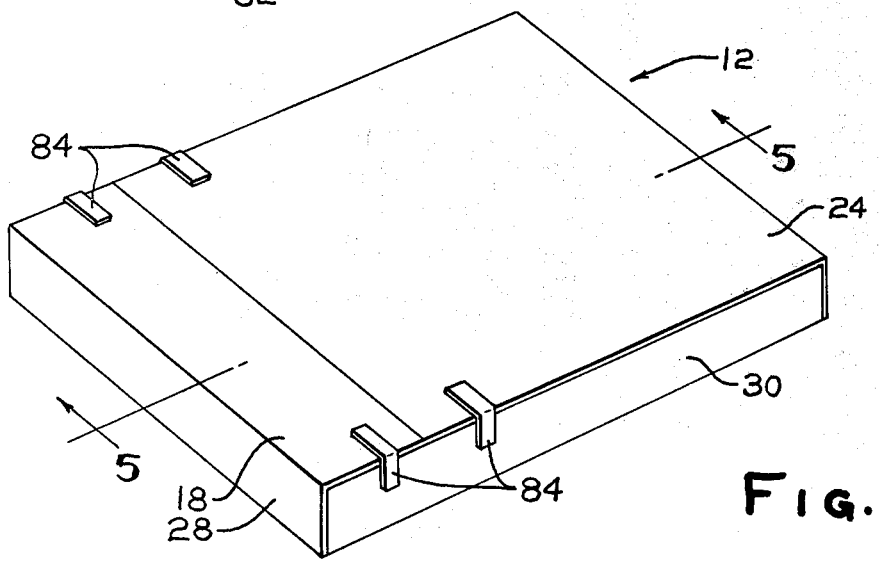
FIG. 2

FLAT GLASS SHIPPING CONTAINER

BACKGROUND OF THE INVENTION

1. Field of the Invention

This invention relates to containers for shipping flat glass.

2. Discussion of the Prior Art and Technical Problems

Corner protectors are normally used in combination with containers for shipping sheets of glass. The corner protectors are used to prevent damage to the sheets of glass when they are accidentally dropped.

Disclosed in U.S. Pat. No. 3,792,771 there is disclosed a package for storing and transporting rectangular glass photographic plates. The package includes a plate carrier member provided with ribs for keeping the plates separated from each other in general parallel relationship, a lid which is placed on top of the plate carrier member, and cushion members of a resilient member which extends normal to the plane of the plates. The resilient member is disposed to contact a portion of the edges of the plates to prevent the plates from rattling between the ribs.

Although the prior art corner protector, e.g., those disclosed in the above-mentioned U.S. Pat. No. 3,792,771, are adequate to absorb shock imparted to the glass plates when the container is accidentally dropped, they are not employed properly to (1) provide adequate protection against stress or pressure points and/or (2) prevent the outermost sheets of glass from slipping between the corner protectors and sufaces of the container.

For example, the problem of stress or pressure points occurs when the corner protectors or ribs maintain sheets of glass in spaced relationship to each other and/or outermost sheets in spaced relationship to adjacent surfaces of the container. When the container is accidentally dropped, major surfaces of the glass sheets or plates bend at the interface with the corner pads or ribs. This bending moment sets up stress or pressure points which can cause the glass to fracture.

In the instance where the corner protectors are provided such that they are flush with a stack of glass sheets, the problem encountered is that during shipment or handling, the outermost glass sheets of the stack tend to slide over the surface of the corner protectors between the top or bottom portion of the container. When the container is accidentally dropped, there is no protection for the outermost glass sheets and the glass sheets are damaged.

It would be advantageous therefore if a corner protector was provided in combination with a shipping container to eliminate the occurrence of stress or pressure points while preventing the outermost glass sheets from sliding between the corner protector and inner surfaces of the container.

SUMMARY OF THE INVENTION

This invention relates to a container for shipping a stack of frangible articles, e.g., flat glass sheets having a generally rectangular shape. A container is provided for receiving and completely encompassing the stack with side portions of the stack in spaced relation to adjacent portions of the receiving and encompassing facility. At least one shock-absorbing, resilient, compressible pad is positioned within the container between [the adjacent portions of] the stack and adjacent inner portion of the container. The pad has a height in the uncompressed state greater than the height of the stack and is compressed by the container to the height of the stack.

In the preferred embodiment, the container includes a member, e.g., a piece of corrigated fiberboard, cut and scored to a generally T-shaped configuration to include a bottom portion, sides, a top lid flap portion, a bottom lid flap portion, a right side flap portion and a left side flap portion. The bottom portion has dimensions greater than the corresponding dimensions of the stack of articles and the width of the sides is approximately equal to the height of the stack.

A shock-absorbing, resilient, compressible pad, e.g., a polyethylene corner pads, having a generally L-shaped configuration is positioned at the corners of the stack. The corner pads are compressed to unitize the stack of glass sheets when the fiberboard is folded along the score lines to provide the container.

BRIEF DESCRIPTION OF THE DRAWING

FIG. 1 is a plan view of a corrigated fiberboard cut and scored to form a container for shipping glass sheets which may use corner pads incorporating features of the invention;

FIG. 2 is an isometric view of a container formed by folding the fiberboard illustrated in FIG. 1;

DESCRIPTION OF THE INVENTION

Figure 3:
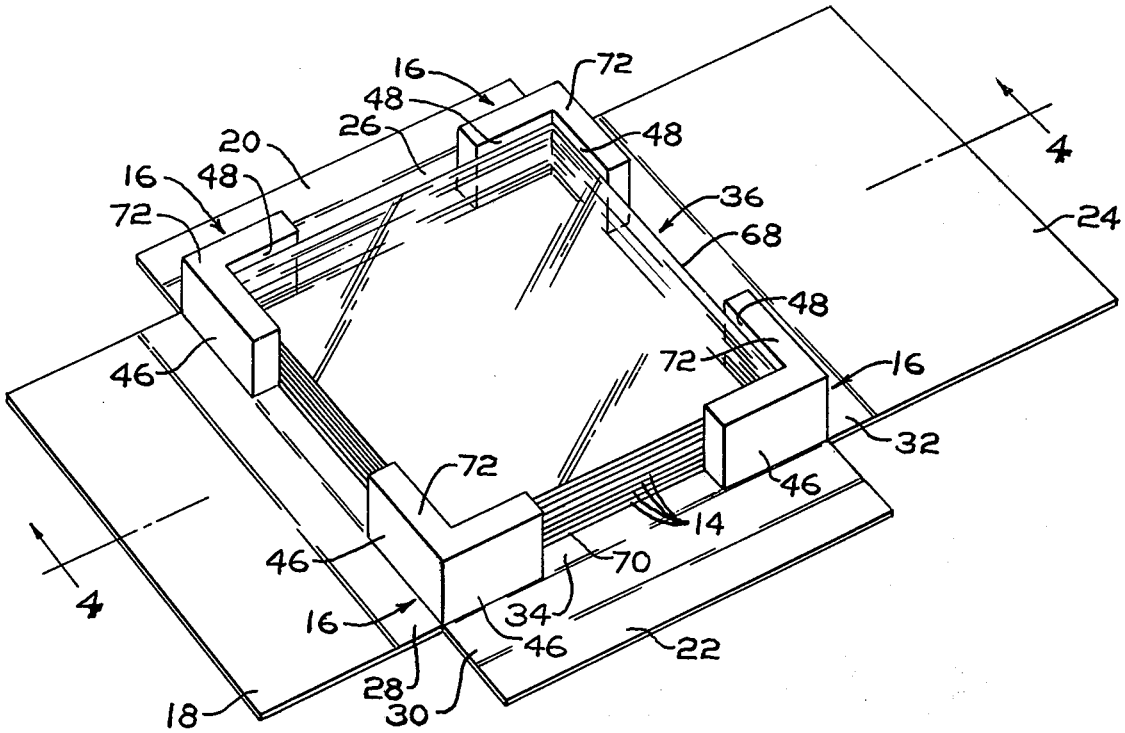
FIG. 3 is an isometric view of the fiberboard of FIG. 1 showing the position of individual glass sheets arranged in a stack and corner pads incorporating features of the invention.

With reference to FIG. 1, there is shown a corrigated fiberboard sheet 10 cut and scored so as to provide a shipping container 12 (see FIG. 2) for shipping articles 14 that may use corner pads 16 (see FIG. 3) constructed in accordance to the teachings of the invention. In the following discussion, the articles are rectangular flat sheets of glass; however, as will be appreciated, the invention is not limited thereto. For example, the sheets of glass may have a circular configuration. Further, in the following discussion, the container is made of fiberboard; however, as will be appreciated, the invention is not limited thereto. For example, the container can be made from a cut and scored plastic corrigated sheet or pressed board.

In general and with continued reference to FIG. 1, the fiberboard 10 is cut and scored to have a generally T-shape configuration including a top lid flap portion 18; a right side flap portion 20; a left side flap portion 22; a bottom lid flap portion 24; sides 26, 28, 30 and 32 and a bottom portion 34.

Referring now to FIG. 3, the individual glass sheets 14 are positioned on the bottom portion 34 of the fiberboard 10 to form a stack 36. As will be appreciated, the invention is not limited to the number of sheets in the stack. The corner pads 16 which are generally L-shaped to fit the corners of the stack 36 are made of a material that (1) absorbs shock; (2) is compressible; and (3) is resilient, i.e., returns to its original shape and size after being compressed. Types of materials that may be used in the practice of the invention are polyethylene, cork or rubber.

Referring back to FIG. 1, the length of the bottom portion 34, as measured between opposed score lines 38 and 40, and the width of the bottom portion, as measured between opposed score lines 42 and 44, is preferably equal to the length of the glass sheet plus the thickness of the corner pads 16 and equal to the width of the glass sheet plus the thickness of the corner pads 16, respectively. In this manner, when the sides 26, 28, 30 and 32 are brought upward against adjacent surface 46 of the corner pads, (shown in FIGS. 3 and 4) surface 48 of the corner pads is urged against the sides of the stack to unitize the stack 42 as shown in FIG. 5. More particularly, the sheets of glass are thereby prevented from sliding within the container during shipment which could mar adjacent glass surfaces.

Figure 4:
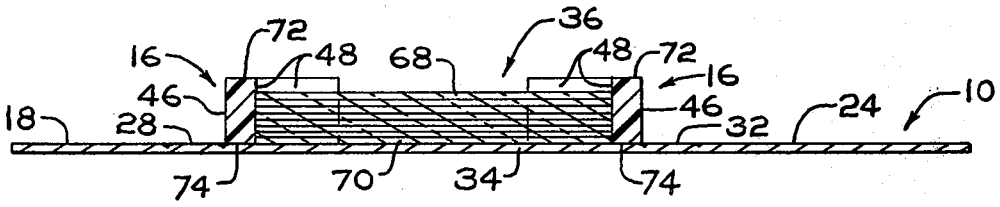
FIG. 4 is a view taken along lines 4—4 of FIG. 3.
Figure 5:
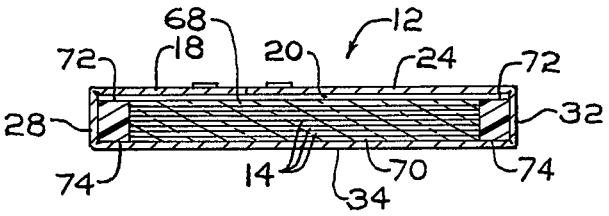
FIG. 5 is a view taken along lines 5—5 of FIG. 2.

With reference to FIG. 4, the thickness of the corner pads 16, as measured between the surfaces 46 and 48 should be sufficient to absorb shock in the instance when the container is dropped without having the sheets of glass cutting through the corner pads. The thickness of the corner pads has been found to be a function of the density of the polyethylene and the weight of individual glass sheets. As the weight of the individual glass sheets increases for a constant density of corner pads, the thickness of the pads should be increased. As the density of the polyethylene increases for a constant weight of the individual glass sheets, the thickness of the corner pads can be decreased.

As can be appreciated by those skilled in the art, the density of the polyethylene should be below that point at which the polyethylene has no shock absorbing qualities. If the desnity is such that the corner pads have no shock absorbing quality, the glass sheets will be damaged when dropped on a side or corner. As a general rule, the thickness of the corner pads should be a minimal 1 inch having a density of 2 pounds, i.e., the polyethylene corner pad is formed under a pressure of 2 pounds per square inch (psi).

As previously mentioned, the material of the corner pads should be resilient so that the sheets of glass are maintained in the container as a unitized pack. For example, when the container is dropped, the individual sheets are urged against the corner pads. If the corner pads do not return to their original size and configuration after the container is repositioned, the sheets of glass will have an increased path of travel which could mar adjacent surfaces of the glass sheets and damage the glass when the container is dropped again. Further, if the pads do not expand to their original size and configuration after being dropped, the corner pads are not able to adequately absorb shock on subsequent drops to prevent damage to the glass sheets.

With reference to FIGS. 1, 2 and 3, the inside depth of the container 12, i.e., the width of sides 26, 28, 30 and 32 as measured between the score lines 42, 60; 38, 62; 44, 64; and 40, 66, respectively, is preferably equal to the height of the stack 36. When the right and left side flap portions 20 and 22, respectively, are folded to form the container 12, the surface of the topmost sheet 68 is flush with the inner surface of the right and left side flap portions 20 and 22, respectively, as shown in FIG. 5 to eliminate pressure points which could cause the glass to fracture when the container is dropped. For example, in the prior art, the practice was to provide corner pads that maintained the outermost sheets of glass in spaced relationship to the top and bottom sections of the container. In this instance, when the container is dropped, the glass tends to bend toward the top or bottom section about the restraint points in the direction of the force. This creates stresses or pressure points at the interface of the glass and corner protectors which can cause the glass to fracture.

By providing the right and left side flap portions of the container flush against the surface of the topmost sheet 68 and the bottommost sheet 70 resting on the bottom portion 34 of the container as viewed in FIG. 5, there are no pressure points which could cause the glass to fracture.

As can be appreciated, the outer surface of the topmost sheet 68 is not in surface contact with the top and bottom lid flap portions 18 and 24, respectively. However, the right and left side flap portions 20 and 22, respectively, are in surface area contact with the topmost sheet 68 which obviates pressure points. This is because the side flap portions 20 and 22 extend between opposite sides of the topmost sheets 68 to eliminate pressure points at the corner of the glass sheet normally associated with corner protectors of the prior art.

With reference to FIG. 4, the height of the corner pads as measured between sides 72 and 74 of the corner pads 16 should be greater than the inside depth of the container so that when the fiberboard 10 is folded to provide the container 12, the corner pads are compressed between side flap portions 20 and 22 and the bottom portion 34. In this manner, movement of the topmost and bottommost glass sheets as viewed in FIG. 5 between the surface 72 and 74, respectively, of the corner pads 16 and adjacent inner surfaces of the side flap portions and bottom portion, respectively, is obviated. For example, in the prior art when individual glass sheets were stacked in surface engagement with the container to obviate the problem of bending moments discussed, supra, the topmost and bottommost glass sheets had a tendency to slide between the absorbing facilities and adjacent inner surfaces of the container. When this occurs, the surfaces and sides of the sliding glass sheets became damaged when the container was dropped because there is no absorbing facility to absorb the shock. By compressing the corner pads, the sheets are maintained in the stack and are prevented from moving between the surface of the corner pads and the adjacent inner surfaces of the container. More particularly and with continued reference to FIG. 5, the topmost sheet 68 is prevented from sliding between surface 72 of the corner pads and inner surface of the right and/or left side flap portions 20 and 22, respectively, and the bottommost sheet 70 is prevented from sliding between surface 74 and inner surface of the bottom portion 34 of the container.

The difference in height between the corner pads and the inner depth of the container is a function of the density of the corner pads. For example, if the height is excessive and the density high, the corner pads will not be compressed and the stack will not be unitized, i.e., the glass sheets will fit loosely in the container. As a general rule, as the density of the corner pads increases, the height of the corner pad should be decreased and vice versa. Generally, for polyethylene having a density of 2 pounds, the difference between the height of the corner pads and the inner depth of the container should be about ⅛ inch.

As can now be appreciated, the length of the legs of the L-shaped corner pads is not limiting to the invention. However, it is recommended that the length of the legs be approximately 6 inches. Further instead of using discrete corner pads, a continuous strip of polyethylene may be provided around the stack 34.

With reference to FIG. 1, the width of the right side flap portion 20 as measured between score line 60 and opposite side 76 and of the left side flap portion 22 as measured between score line 64 and opposite side 78 is not limiting to the invention. However, it is recommended that the width of the side flap portions be at least 3 inches (1) to provide ease of folding the flap portions along their respective score lines and (2) to prevent the side flap portions from slipping from beneath the top and bottom flap portions 18 and 24, respectively, when the container 12 (shown in FIG. 2) is formed.

The width of the top flap portion 18 as measured between the score line 62 and opposed side 80 and of the bottom flap portion 24 as measured between the score line 66 and opposite side 82 should be sufficient to completely cover the stack 36 as shown in FIGS. 2 and 5. The top and bottom flap portions may be held in place with tape 84 as shown in FIG. 2 or with glue applied in any conventional manner.

Figure 6:
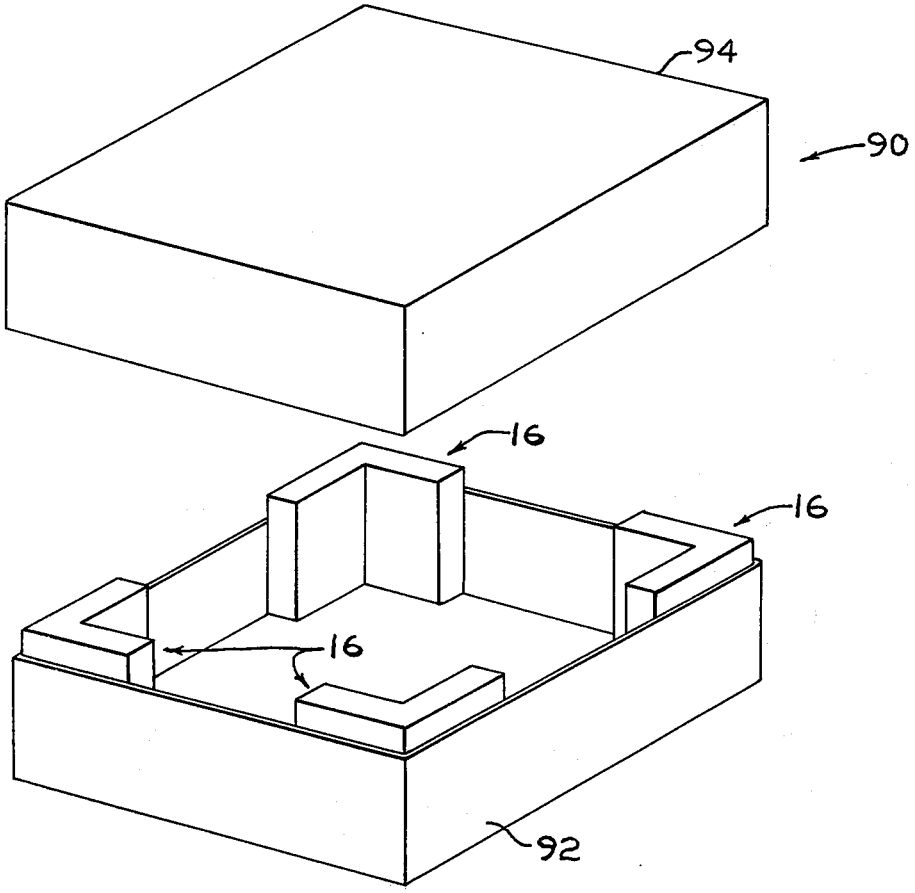
FIG. 6 is an isometric view of a box type container for shipping glass sheets that may use the corner pads of the invention.

As can now be appreciated, the invention is not limited to those instances where the container is formed from a single sheet of fiberboard. With reference to FIG. 6, there is shown a shipping container 90 in the form of a box that may use the corner pads 16 in accordance with the teachings of the invention. In this instance, the corner pads 16 are higher than the inside depth of bottom portion 92 of the box 90 so that when lid portion 94 is positioned on the bottom portion 92 and secured thereto as by tape, the corner pads 16 are compressed to operate in a manner as previously discussed.

Figure 7:
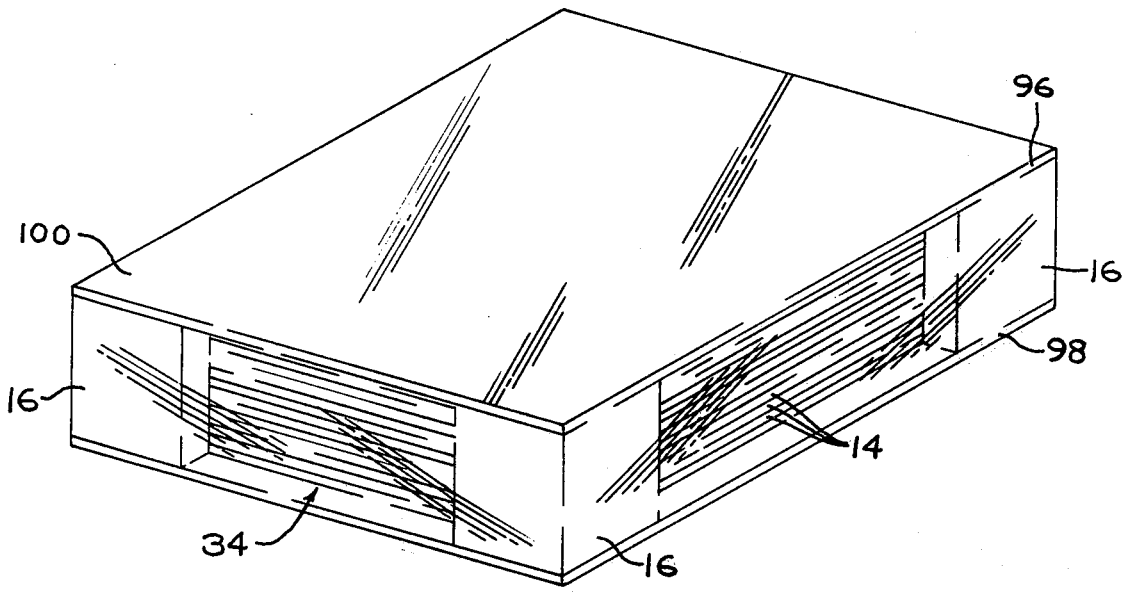
FIG. 7 is an isometric view of another type of container for shipping glass that may use the corner pads of the invention.

With reference to FIG. 7, there is shown still another embodiment of the invention. In this embodiment, the stack 36 of the glass sheets 14 and corner pads 16 are positioned between pieces of corrigated fiberboard 96 and 98. The corner pads 16 are higher than the stack 36 of glass sheets 14.

A sheet of plastic 100 completely surrounds the corner pads and pieces of fiberboard 96 and 98 and is shrink fitted in a manner known in the art. Shrinking the plastic sheet 100 compresses the corner pads between the pieces of fiberboard 96 and 98 to the height of the stack 36.

DETAILED DESCRIPTION OF THE INVENTION

The shipping container and corner pads will be used in accordance to the teachings of the invention for containing 13 sheets of flat glass 14. Referring to FIG. 3, the glass sheets 14 each have dimensions of 24 inches by 24 inches and a thickness of approximately 0.097 inches.

With reference to FIG. 1, a sheet of single wall corrigated 200 pounds per square inch (psi) test fiberboard is cut and scored to form a generally T-shaped fiberboard 10 including a top lid flap portion 18, a right and left side flap portion 20 and 22, respectively, a bottom flap portion 24; sides 26, 28, 30 and 32 and a bottom portion 34.

The width of the top lid flap portion 18 as measured between score line 62 and opposite side 80 is 6 inches and the length is 26 inches. The width of the right side flap portion 20 as measured between score line 60 and opposite side 76 is 3 inches and the length is 26 inches. The width of the left side flap portion 22 as measured between score line 64 and opposite side 78 is 3 inches and the length is 26 inches. The width of sides 26, 28, 30 and 32 as measured between score lines 42 and 60; 38 and 62; 44 and 64; and 40 and 66, respectively, is about 1¼ inches. The length of each side 26, 28, 30 and 32 is 26 inches. The dimension of the bottom portion 34 as measured between the score lines 38 and 40 is 26 inches and between the score lines 42 and 44 is 26 inches.

With reference to FIG. 3, the individual glass sheets 14 are positioned on top of each other on the bottom portion 34 of the fiberboard 10 to form a stack 36. The glass sheets are advantageously separated by an interleaver material such as wood flour to prevent marring of adjacent surfaces.

Referring now to FIGS. 3 and 4, at each corner of the stack 36, there is provided a generally L-shaped corner pad 14 made of polyethylene and having a 2 pound density. The thickness of the corner pad as measured between surfaces 46 and 48 is 1 inch and the height of the corner pads as measured between surfaces 72 and 74 is 1⅜ inches. The length of each leg of the corner pad is about 6 inches.

The sides 26 and 30 of the fiberboard 10 are brought against the corner pads by bending the fiberboard along score lines 42 and 44, respectively, to urge the surface 48 of the corner pads against the sides of the stack. The right and left cover portion 20 and 22 are brought over the surface 72 of the corner pad and topmost glass sheet 68 by folding the fiberboard along score lines 60 and 64, respectively, to compress the corner pads between the side flap portions and the bottom portion 34 of the fiberboard 10.

The sides 28 and 32 are urged against the surface 46 of the corner pads by folding the fiberboard along score lines 38 and 40, respectively, to urge the surfaces 48 against adjacent side of the stack while compressing the corner pads between the side flap portions and the bottom portion of the fiberboard. The top and bottom flap portions 18 and 24 are folded over the right and left cover portions by folding the fiberboard along score lines 62 and 66, respectively. The top and bottom cover portions are maintained in position by tape 84 as shown in FIG. 2.

When the container is accidentally dropped during shipment, the glass sheets move against the corner pads which absorb the shock and prevent the glass from cracking. When the container is picked up and moved to a flat position, the corner pads return to their original size and configuration thereby maintaining the movement of the glass at a minimum. Further, and with reference to FIG. 5, during shipment, the topmost and bottommost sheets 68 and 70, respectively, of the stack 36 are maintained in the stack by the corner pads being compressed when the container was formed. In other words, the stack is unitized. Further, should the container be accidentally dropped, there are no pressure points which would cause the glass to crack. This is because the bottommost sheet 70 is flush with the bottom portion 34 and the topmost sheet 68 is flush with the side flap portions 20 and 22 (see FIG. 5). The side flap portions 20 and 22 extend across a portion of the topmost sheet 68 between opposed sides thereof to provide more surface area contact thereby eliminating pressure points.

What is claimed is:

1. A container for shipping a stack of flat glass sheets having a generally rectangular shape wherein the width, length and height of the stack are of predetermined dimensions, comprising:

a corrigated fiberboard cut and scored to a generally T-shaped configuration to include a bottom portion, sides, a top lid flap portion, a bottom lid flap portion, a right side flap portion and a left side flap portion, said bottom portion having dimensions greater than corresponding dimensions of the stack of glass sheets and the width of said sides approximately equal to the height of the stack; and corner pad made of a resilient, compressible, shock-absorbing material positioned at the corners of said base and having a height in the uncompressed state greater than the width of said sides, and a thickness approximately equal to the difference between the corresponding dimension of the stack and of said base, said corner pads being compressed between said corresponding side flap portion and bottom portion when the container is formed from said fiberboard to unitize the stack of glass sheets.

2. The container as set forth in claim 1 wherein the corner pads are made of polyethylene.

3. A shipping container, comprising:

a stack of flat frangible articles, in face-to-face relationship;

at least one resilient, compressible shock-absorbing means having a height in the uncompressed state greater than the height of said stack; and means for receiving and completely encompassing said stack and said at least one resilient, compressible shock-absorbing means and for compressing the height of said at least one shock-absorbing means to approximately the height of said stack wherein said receiving and encompassing and compressing means comprises:

a base for supporting said stack and said at least one resilient, compressible, shock-absorbing means; and sidewalls having a height approximately equal to the height of said stack and encompassing sides of said stack and said at least one shock-absorbing means wherein said sidewalls and said at least one shock-absorbing means prevents face-to-face displacement of the articles.

4. The container as set forth in claim 3 wherein the sheets have a rectangular shape and said shock-absorbing means is a corner pad positioned at each corner of said stack.

5. The container as set forth in claim 3 wherein the sheets have a circular shape and a plurality of said shock-absorbing means are positioned at selective spaced intervals about said stack.

6. The container as set forth in claim 3 wherein said at least one shock-absorbing, resilient, compressible means is made of polyethylene.

7. The container as set forth in claim 3 wherein said at least one shock-absorbing, resilient, compressible means is made of cork.

8. The container as set forth in claim 3 wherein said at least one shock-absorbing, resilient, compressible means is made of rubber.

9. The container as set forth in claim 3 wherein the articles are flat glass sheets.

10. The container as set forth in claim 3 wherein said means for receiving and completely encompassing and for compressing includes:

a monolithic member cut and scored to a generally T-shaped configuration to include said base, sidewalls, a top lid flap portion, a bottom lid flap portion, a right side flap portion and a left side flap portion.

11. The container as set forth in claim 3 wherein said means for receiving and completely encompassing and for compressing includes:

a receptacle for receiving said stack of articles, said receptacle having said base and sidewalls integral with said base, said sidewalls having a height approximately equal to the height of said stack of articles;

a lid for enclosing the articles in said receptacle wherein said at least one shock-absorbing, resilient, compressible means is compressed between said lid and said base to prevent face-to-face displacement of the articles; and means for securing said lid on said receptacle.

12. The container as set forth in claim 3 wherein said means for receiving and completely encompassing and for compressing includes:

a first flat member for supporting said stack and said at least one shock-absorbing means;

a second flat member positioned on top of said stack and said at least one shock-absorbing means, to form a composite;

means for completely encompassing the composite and compressing said at least one shock-absorbing, resilient, compressible means between said first and second flat member to prevent face-to-face displacement of the articles.

13. The container as set forth in claim 12 wherein said encompassing and compressing means includes a heat shrinkable platic sheet.

* * * * *